US008013829B2

(12) United States Patent
Chen et al.

(10) Patent No.: US 8,013,829 B2
(45) Date of Patent: Sep. 6, 2011

(54) LIQUID CRYSTAL DISPLAY HAVING BLACK INSERTION CONTROLLER SELECTING BLACK INSERTION CONTROL SIGNALS ACCORDING TO DATA STORED THEREIN AND DRIVING METHOD THEREOF

(75) Inventors: Eddy Giing-Lii Chen, Miao-Li (TW); Sz-Hsiao Chen, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 835 days.

(21) Appl. No.: 12/072,816

(22) Filed: Feb. 28, 2008

(65) Prior Publication Data

US 2008/0204433 A1 Aug. 28, 2008

(30) Foreign Application Priority Data

Feb. 28, 2007 (CN) ..... 2007 1 0073411

(51) Int. Cl.
*G09G 3/36* (2006.01)

(52) U.S. Cl. ..... 345/100

(58) Field of Classification Search ..... 345/87, 345/94, 96, 204, 209, 690, 692, 693, 100
See application file for complete search history.

(56) References Cited

U.S. PATENT DOCUMENTS

| | | | | |
|---|---|---|---|---|
| 5,040,874 | A | 8/1991 | Fukuda | |
| 6,396,469 | B1 | 5/2002 | Miwa et al. | |
| 6,442,297 | B1 * | 8/2002 | Kondo et al. | 382/240 |
| 7,403,185 | B2 * | 7/2008 | Song et al. | 345/100 |
| 2002/0196220 | A1 * | 12/2002 | Sato et al. | 345/87 |

FOREIGN PATENT DOCUMENTS

CN 1043795 A 7/1990

* cited by examiner

*Primary Examiner* — Chanh Nguyen
*Assistant Examiner* — Ram Mistry
(74) *Attorney, Agent, or Firm* — Altis Law Group, Inc.

(57) ABSTRACT

An exemplary liquid crystal display (300) includes a liquid crystal panel (301), a data circuit (303), and a black insertion controller (305). The liquid crystal panel includes a plurality of pixels (330). The black insertion controller receives a display signal of the pixel, and generates a black insertion control signal according to an address of the pixel, and the data circuit drives the pixel to display one of a black image unit and a normal image unit according to the black insertion control signal in a first sub-frame period of a frame period. The displayed black image unit of the pixel or the displayed normal image unit is converted into a normal image unit or a black image unit in a second sub-frame period of the frame period. A method for driving the liquid crystal display is also provided.

19 Claims, 6 Drawing Sheets

LIQUID CRYSTAL DISPLAY HAVING BLACK INSERTION CONTROLLER SELECTING BLACK INSERTION CONTROL SIGNALS ACCORDING TO DATA STORED THEREIN AND DRIVING METHOD THEREOF

FIELD OF THE INVENTION

The present invention relates to liquid crystal displays (LCDs), and more particularly to an LCD having a black insertion controller. The present invention also relates to a method for driving the LCD.

GENERAL BACKGROUND

LCDs are widely used in various modern information products, such as notebooks, personal digital assistants, video cameras and the like.

When motion pictures are introduced to an LCD, an image of the previous frame may remain in visual perception of a viewer as an afterimage. The afterimage overlaps with an image of the current frame in the perception of the viewer. This causes a so-called residual image phenomenon to be generated, accordingly a display quality of the LCD is impaired. To overcome the above-described problem, a method called as black insertion driving is provided to drive the LCD.

FIG. 7 is an abbreviated circuit diagram of a conventional LCD, which is capable of utilizing the black insertion driving method. The LCD 100 includes a liquid crystal panel 101, a scanning circuit 102, and a data circuit 103. The scanning circuit 102 and the data circuit 103 are configured for driving the liquid crystal panel 101.

The liquid crystal panel 101 includes n rows of parallel scanning lines 110 (where n is a natural number), m columns of parallel data lines 120 orthogonal to the n rows of parallel scanning lines 110 (where m is also a natural number), and a plurality of pixels 130 cooperatively defined by the crossing scanning lines 110 and data lines 120. The scanning lines 110 are electrically coupled to the scanning circuit 102. The data lines 120 are electrically coupled to the data circuit 103.

Each pixel 130 includes a thin film transistor (TFT) 131, a pixel electrode 132, a common electrode 134, and liquid crystal molecules (not labeled) interposed between the pixel electrode 132 and the common electrode 134. The TFT 131 is disposed near an intersection of a corresponding one of the scanning lines 110 and a corresponding one of the data lines 120. A gate electrode of the TFT 131 is electrically coupled to the corresponding one of the scanning lines 110, and a source electrode of the TFT 131 is electrically coupled to the corresponding one of the data lines 120. Further, a drain electrode of the TFT 131 is electrically coupled to the pixel electrode 132. The common electrode 203 is electrically coupled to a common voltage generating circuit (not shown) that is configured to provide common voltages. Moreover, each pixel electrode 132, the corresponding common electrode 134, and the liquid crystal molecules therebetween cooperatively form a liquid crystal capacitor 133.

When the LCD 100 is driven via the black insertion driving method, each frame period is divided into a first sub-frame period and a second sub-frame period. In particular, the first sub-frame period serves as a normal display period, and the second sub-frame period serves as a black frame insertion period.

During the first sub-frame period, a plurality of first scanning signals are generated by the scanning circuit 102, and are sequentially supplied to the scanning lines 110, so as to scan the corresponding pixels 130 row by row. When the corresponding row of pixels 130 is scanned by the first scanning signal, the TFTs 131 of the pixels are switched on. The data circuit 103 then supplies a plurality of first driving voltages to the pixel electrodes 132 of the pixels 130 via the data lines 120 and the TFTs 131, so as to charge the liquid crystal capacitors 133. Moreover, common voltages are applied to the common electrodes 134 of the pixels 130 by the common voltage generating circuit. Thereby, when the charging process is finished, an electric field is generated between the pixel electrode 132 and the common electrode 134 of each pixel 130, and the electric field is retained until the pixel 130 is scanned once again in a following sub-frame period. The electric field drives the liquid crystal molecules of the pixel 130 to tilt to a corresponding angle, so as to control the light transmission of the pixel 130. Accordingly the pixel 130 displays an image unit having a corresponding gray level.

After the last row of pixels 130 are scanned and the liquid crystal capacitors 133 thereof are charged, the first sub-frame period is finished and the second sub-frame period starts thereafter.

During the second sub-frame period, the scanning circuit 102 supplies a plurality of second scanning signals to switch on the TFTs 131 of pixels 130 row by row. The common voltages are kept on providing to the common electrodes 134. The data circuit 103 supplies a plurality of second driving voltages having values the same as that of the corresponding common voltages to the pixel electrodes 132 of the pixels 130. This causes the liquid crystal capacitor 133 of each pixel 130 to be discharged. When the discharging process is finished, the electric field is removed. Thereby, the liquid crystal molecules of the pixel 130 return to the original positions, so as to prevent light beams from transmitting therethrough, such that each pixel 130 of the LCD 100 displays a black image unit. That is, a sub-frame of black image is inserted between two successive sub-frames of normal images.

By employing the black insertion driving method, normal images and black images are displayed alternately. In a complete frame period, a viewer perceives the normal image during the first sub-frame period, and perceives the black image during the second sub-frame period. Thus an afterimage of the image displayed in the first sub-frame period is removed from the perception during of the viewer in the second sub-frame period. This means that the problem of the residual image phenomenon can be solved.

However, when the LCD 100 displays a still image in a plurality of sequential frames period, the alternation of the normal image and the black image may cause a so-called flicker phenomenon to be generated. A viewer may perceive that the image displayed in the LCD 100 is skipping or jumping. This causes the display quality of the LCD to be low all the same.

It is, therefore, desired to provide an LCD and a method for driving the LCD which overcome the above-described deficiencies.

SUMMARY

In a first aspect, a liquid crystal panel includes a plurality of pixels, a data circuit configured for driving the pixels, and a black insertion controller configured for controlling the data circuit to provide corresponding driving voltages for the pixels. The black insertion controller receives a display signal of the pixel, and generates a black insertion control signal according to the address of the pixel, and the data circuit drives the pixel to display one of a black image unit and a normal image unit according to the black insertion control signal in a first sub-frame period of a frame period. The displayed black image unit of the pixel or the displayed normal image unit is converted into a normal image unit or a black image unit in a second sub-frame period of the frame period.

In a second aspect, a method for driving a liquid crystal display, the method comprising: dividing a frame period into a first sub-frame period and a second sub-frame period; providing a display signal and determining an address of a pixel corresponding to the display signal; providing a black insertion controller to generate a black insertion control signal according to the address of the pixel; providing a data circuit to drive the pixel to display one of a black image unit and a normal image unit according to the first black insertion control signal; converting the displayed black image unit into a normal image unit, or converting the displayed normal image unit into a black image. Steps (b), (c), and (d) are operated in the first sub-frame period, and step (e) is operated in the second sub-frame period.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
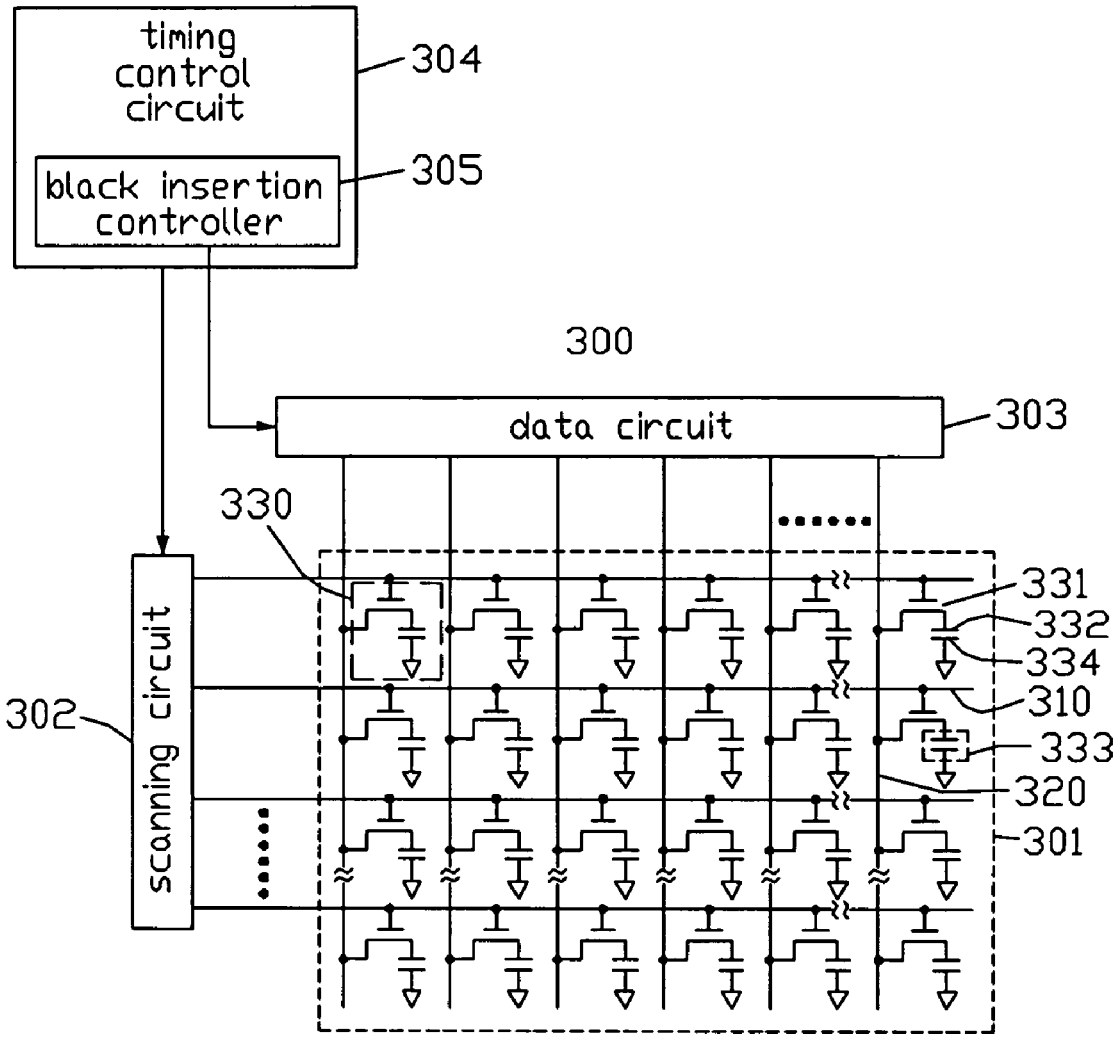
FIG. 1 is an abbreviated circuit diagram of an LCD according to an exemplary embodiment of the present invention, the LCD including a black insertion controller having a plurality of black insertion control unit.

FIG. 1 is an abbreviated circuit diagram of an LCD according to an exemplary embodiment of the present invention. The LCD 300 includes a liquid crystal panel 301, a scanning circuit 302, a data circuit 303, and a timing control circuit 304. The scanning circuit 302 and the data circuit 303 are configured for driving the liquid crystal panel 301. The timing control circuit 304 is configured for controlling driving timing of the scanning circuit 302 and the data circuit 303.

The liquid crystal panel 301 includes, n rows of parallel scanning lines 310 (where n is a natural number), m columns of parallel data lines 320 orthogonal to the n rows of parallel scanning lines 310 (where m is also a natural number), and a plurality of pixels 330 cooperatively defined by the crossing scanning lines 310 and data lines 320. The scanning lines 310 are electrically coupled to the scanning circuit 302. The data lines 320 are electrically coupled to the data circuit 303. Moreover, the plurality of pixels 330 are arrayed in a matrix manner, so as to form an active matrix cooperatively.

Each pixel 330 includes a thin film transistor (TFT) 331, a pixel electrode 332, a common electrode 334, and liquid crystal molecules (not labeled) interposed between the pixel electrode 332 and the common electrode 334. The TFT 331 is disposed near an intersection of a corresponding one of the scanning lines 310 and a corresponding one of the data lines 320. A gate electrode of the TFT 331 is electrically coupled to the corresponding one of the scanning lines 310, and a source electrode of the TFT 331 is electrically coupled to the corresponding one of the data lines 320. Further, a drain electrode of the TFT 331 is electrically coupled to the pixel electrode 332. The common electrode 303 is electrically coupled to a common voltage generating circuit that is configured to provide common voltages. Moreover, each pixel electrode 332, the corresponding common electrode 334, and the liquid crystal molecules therebetween cooperatively form a liquid crystal capacitor 333.

The timing controller 304 includes a black insertion controller 305 disposed therein. The black insertion controller 305 is configured to control the data circuit 303 to drive the pixels 330 to display black image units in predetermined timings. The black insertion controller 305 includes a plurality of black insertion control units (not labeled).

Figure 2:
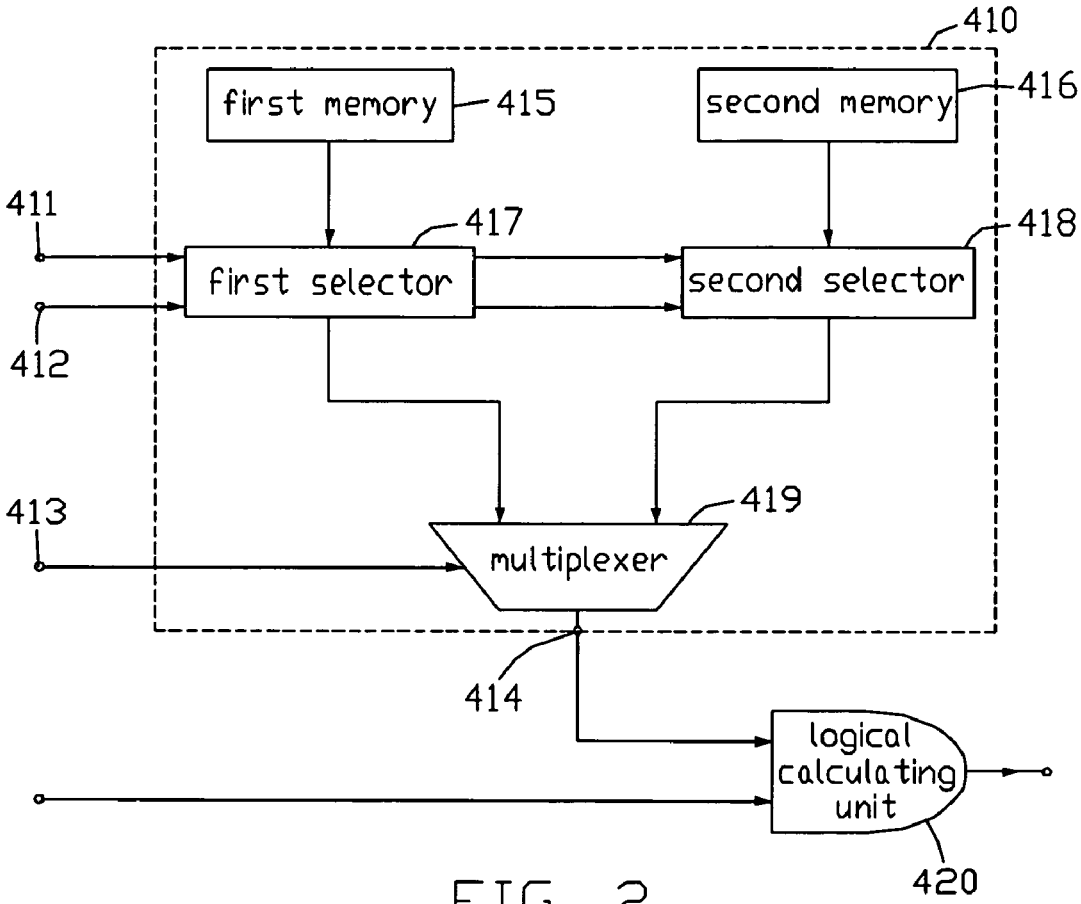
FIG. 2 is a circuit diagram of the black insertion control unit of the black insertion controller of the LCD of FIG. 1.

FIG. 2 is a circuit diagram of the black insertion control unit. The black insertion control unit includes a control signal generator 410 and a logical calculating unit 420. The control signal generator 410 is configured to provide a black insertion control signal of a target pixel 330 according to a position in which the target pixel 330 locates. The logical calculating unit 420 is configured for carrying out Boolean calculation between a digital display signal of the target pixel 330 and the black insertion control signal. The logical calculating unit 420 can be a logical AND gate.

The control signal generator 410 includes a first input terminal 411, a second input terminal 412, a third input terminal 413, an output terminal 414, a first memory 415, a second memory 416, a first selector 417, a second selector 418, and a multiplexer 419. The first and second input terminals 411, 412 serve as control terminals of both of the first and second selectors 417, 418, and are electrically coupled to an address register (not shown). In particular, the first input terminal 411 is used to receive a least significant bit (LSB) of a horizontal address of the target pixel 330 from the address register. The second input terminal 412 is used to receive an LSB of a vertical address of the target pixel 330. Moreover, the third input terminal 413 serves as a control terminal of the multiplexer 419, and is used to receive a timing control signal generated by the timing control circuit 303.

Each of the first and second memories 415, 416 is capable of storing four bits data. In particular, the first four bits data 0110 are stored in the first memory 415, and the second four bits data 1001 are stored in the second memory 416. Each of the first and second selectors 417, 418 is a one-of-four data selector. The first selector 417 is electrically coupled to the first memory 415, and the second selector 418 is electrically coupled to the second memory 416. The multiplexer 419 includes two input terminals (not labeled) and an output terminal (not labeled). One of the input terminals of the multiplexer 419 is electrically coupled to first selector 417, and the other input terminal of the multiplexer 419 is electrically coupled to the second selector 418. The output terminal of the multiplexer 419 is electrically coupled to the output terminal 414 of the control signal generator 410, and is configured for outputting the black insertion control signal to the logical calculating unit 420.

Figure 3:
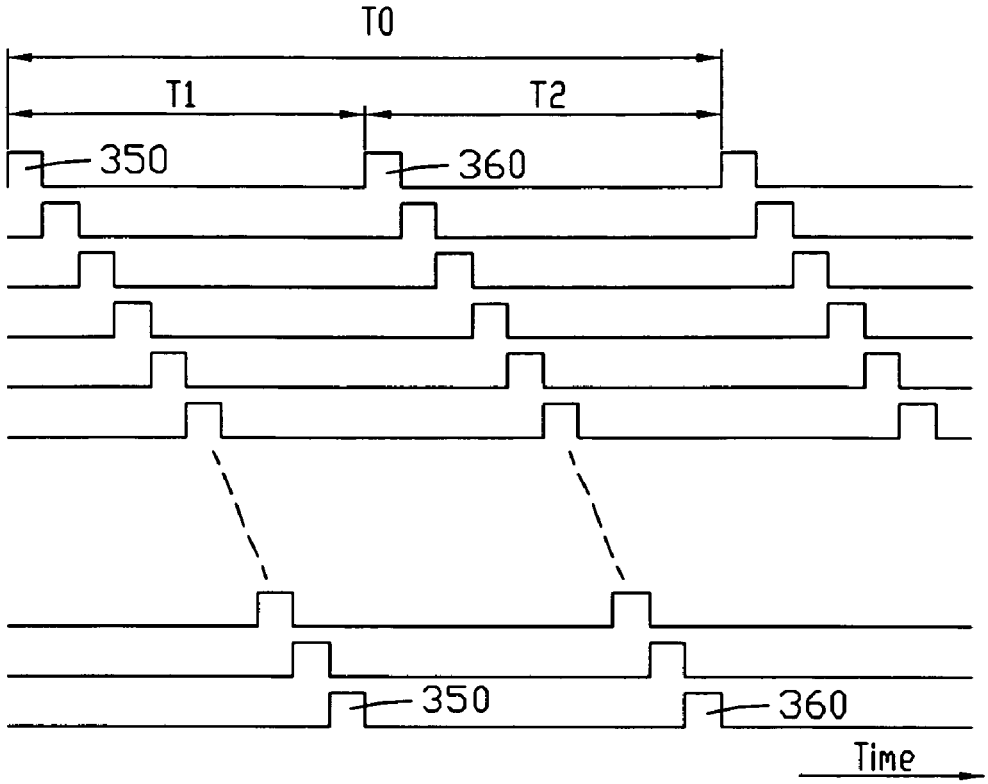
FIG. 3 is a timing chart schematically illustrating a scanning timing of the LCD of FIG. 1.

Referring to FIG. 3, a scanning timing of the LCD 300 is schematically shown. When the LCD 300 is in operation, each frame period T0 is divided into a former first sub-frame period T1 and a latter second sub-frame period T2. In particular, a time span of the first sub-frame period T1 is the same as that of the second sub-frame period T2. Details of the operations of the LCD 300 in the first sub-frame period T1 and the second sub-frame period T2 are respectively described as follows.

During the first sub-frame period T1, the scanning circuit 302 generates a plurality of first scanning signals 350 according to timing signals outputted from the timing control circuit 304, and sequentially supplies the first scanning signals 350 to the scanning lines 310. Thereby, the pixels 330 are scanned row by row, that is, the pixels 330 are scanned in that order from the uppermost row to the lowermost row. Moreover, when a corresponding row of pixels 330 are scanned, the TFTs 331 of the pixels 330 are switched on, such that the pixels 330 are activated.

Each black insertion control unit of the black insertion controller 305 receives LSBs of the horizontal and vertical addresses of the target pixel 330 via the first and second input terminals 411, 412 respectively. The LSBs of the horizontal and vertical addresses of the target pixel 330 controls the first selector 417 to read a corresponding datum from the first four bits data 0110 stored in the first memory 415, and also controls the second selector 418 to read a corresponding datum from the second four bits data 1001 stored in the second memory 416.

In detail, when the target pixel 330 is in an odd row and an odd column of the active matrix, that is, the LSBs of the horizontal and vertical addresses thereof are both 0, the first selector 417 reads an LSB of the first four bits data 0110 (i.e. 0), and the second selector 418 reads an LSB of the second four bits data 1001 (i.e. 1). When the target pixel 330 is in an odd row and an even column of the active matrix, that is, the LSBs of the horizontal and vertical addresses thereof are respectively 0 and 1, the first selector 417 reads a sub-least significant bit of the first four bits data 0110 (i.e. 1), and the second selector 418 reads a sub-least significant bit of the second four bit data 1001 (i.e. 0). When target pixel 330 is in an even row and an odd column of the active matrix, that is, the LSBs of the horizontal and vertical addresses thereof are respectively 1 and 0, the first selector 417 reads a sub-most significant bit of the first four bits data 0110 (i.e. 1), and the second selector 418 reads a sub-most significant bit of the second four bit data 1001 (i.e. 0). When target pixel 330 is in an even row and an even column of the active matrix, that is, the LSBs of the horizontal and vertical addresses thereof are respectively 1 and 1, the first selector 417 reads a most significant bit (MSB) of the first four bits data 0110 (i.e. 0), and the second selector 418 reads an MSB of the second four bit data 1001 (i.e. 1).

Based on the above description, relationships between the LSBs of the horizontal and vertical addresses of the target pixel 330 and the data read by the first and second selectors 417, 418 can be shown in the following table. In the table, the former datum in each bracket represents the datum read by the first selector 417, and the latter datum in each bracket represents the datum read by the second selector 418.

| | | LSB of horizontal address | |
|---|---|---|---|
| | | 0 | 1 |
| LSB of vertical address | 0 | (0, 1) | (1, 0) |
| | 1 | (1, 0) | (0, 1) |

As shown in the table, each pair of data read by the first and second selectors 417, 418 are opposite to each other (i.e. one is 0, and the other one is 1), wherever the target pixel 330 locates. Moreover, when the LSBs of the horizontal addresses between two target pixels 330 are opposite to each other (e.g. the two target pixels 330 are adjacent and in a same row), the data read by the first and second selectors 417, 418 corresponding to one of the two target pixels 330 are opposite to that corresponding to the other one of the two target pixels 330. Similarly, when the LSBs of the vertical addresses between two target pixels 330 are opposite to each other (e.g. the two target pixels 330 are adjacent and in a same column), the data read by the first and second selectors 417, 418 corresponding to one of the two target pixels 330 are also opposite to that corresponding to the other one of the two target pixels 330.

The data read by the first and second selectors 417, 418 is then received by the multiplexer 419 via the first and second input terminals thereof respectively. A first timing control signal generated by the timing control circuit 303 is also received by the multiplexer 419 via the third input terminal 413 of the black insertion control unit. The first timing control signal controls the multiplexer 419 to select the datum received by the first input terminal thereof to be a first black insertion control signal. The first black insertion control signal is then outputted to the logical calculating unit 420 via the output terminal 414 of the black insertion control unit.

Simultaneously, a digital display signal of the target pixel 330 is received by the logical calculating unit 420. The logical calculating unit 420 carries out Boolean AND calculation between the digital display signal and the first black insertion control signal, so as to get a first calculation result. Then the first calculation result is outputted to the data circuit 303, and is converted to a first driving voltage by the data circuit 303. The first driving voltage is applied to the pixel electrode 332 of the target pixel 330 via the corresponding one of the data lines 320 and the corresponding TFT 331. The driving voltage, together with a common voltage outputted to the common electrode 334 of the target pixel 330 by the common voltage generating circuit, cooperatively drive the target pixel 330 to display a corresponding image unit. Moreover, all the image units cooperatively form a first image displayed in the liquid crystal panel 301.

In detail, when the first black insertion control signal is 1, the first calculation result of the logical calculating unit 420 is the same as the digital display signal. The data circuit 303 converts the first calculation result into a corresponding normal driving voltage. The normal driving voltage charges the liquid crystal capacitor 333 of the target pixel 330. Thereby, when the charging process is finished, an electric field is generated between the pixel electrode 332 and the common electrode 334, and the electric field is retained until the target pixel 330 is scanned once again in a following sub-frame period T2. The electric field causes the liquid crystal molecules of the target pixel 330 to tilt to a corresponding angle, so as to control the light transmission, and accordingly the target pixel 330 displays a normal image unit having a corresponding gray level. To simplify the following description, hereinafter such normal image unit is called as a first type of image unit.

Conversely, when the first black insertion control signal is 0, the first calculation result of the logical calculating unit 420 is the same as the first black insertion control signal. In this situation, the first black insertion control signal serves as a so-called black signal, and is then converted to a black driving voltage having a value the same as that of the common voltage. When such black driving voltage is applied to the target pixel 330, the liquid crystal capacitor 333 of target pixel 330 is driven to discharge. When the discharging process is finished, the electric field is removed. The liquid crystal molecules of the target pixel 330 return to the original positions, and prevent light beams from transmitting therethrough. Thereby, the target pixel 330 displays a black image unit. Similar to the definition of the first type of image unit, hereinafter such black image unit is called as a second type of image unit.

As described above, when two target pixels 330 is directly adjacent to each other, each of the data read by the first and second selectors 417, 418 corresponding to one of the two target pixels 330 is also opposite to that corresponding to the other one of the two target pixels 330. Thus in the whole image displayed by the LCD 300 during the first sub-frame period T1, the first type of image units and the second type of image units are alternately arrayed in each row and column. That is, each pixel 330 and the directly adjacent pixel 330 thereof display image units with different types, and each pixel 330 and the diagonally adjacent pixel 330 thereof display image units with a same type.

Moreover, after the lowermost row of pixels 330 are scanned and the liquid crystal capacitors 333 thereof are charged, the first sub-frame period T1 is finished and the second sub-frame period T2 starts thereafter.

During the second sub-frame period T2, the scanning circuit 302 supplies a plurality of second scanning signals 360 to activate the pixels 330 row by row. When a corresponding row of pixels 330 is scanned by the second scanning signals 360, the TFTs 331 are switched on once again.

The multiplexer 419 receives a second timing control signal generated by the timing control circuit 303 via the third input terminal 413. The second timing control signal controls the multiplexer 419 to select the datum received by the second input terminal thereof to be a second black insertion control signal. The second black insertion control signal is then outputted to the logical calculating unit 420. Then the logical calculating unit 420 carries out Boolean AND calculation between the digital display signal and the second black insertion control signal, so as to get a second calculation result. The data circuit 303 then converts the second calculation result to a corresponding driving voltage, and drive the target pixel 330 to a new corresponding image unit.

Because the data read by the first and second selectors 417, 418 are opposite to each other, the second black insertion control signal is opposite to the first black insertion control signal. Thereby, when the target pixel 330 displays a normal image unit in the first sub-frame period T1, it displays a black image unit in the second sub-frame period T2. When the target pixel 330 displays a black image unit in the first sub-frame period T1, it displays a normal image unit in the second sub-frame period T2. That is, all the displayed image units of the first sub-frame of image in the LCD 300 are converted to different types of image units in the second sub-frame period T2. Thereby, the displayed first image in the liquid crystal panel 301 is converted to a full new second image including all the image units in the second sub-frame period T2.

Figure 4:
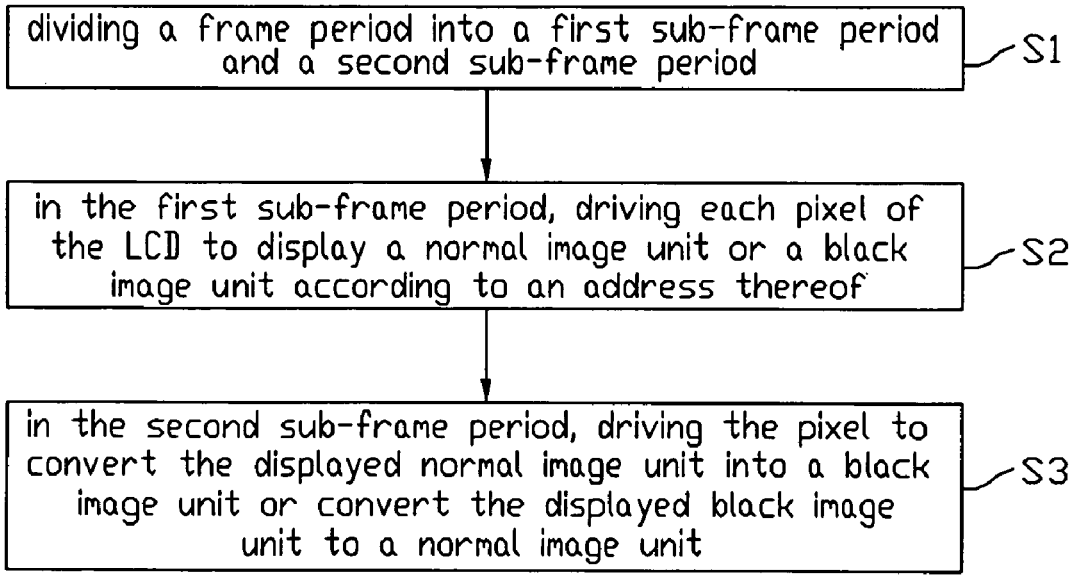
FIG. 4 is a flow chart of an exemplary driving method of the LCD of FIG. 1, the driving method including S1, S2, and S3.

In summary, referring to FIG. 4, the LCD 300 according to the present invention can be driven via a driving method including: step S1, dividing a frame period T0 into a first sub-frame period T1 and a second sub-frame period T2; step S2, in the first sub-frame period T1, driving each pixel 330 of the LCD 300 to display a normal image unit or a black image unit according to an address thereof; and step S3, in the second sub-frame period T2, driving the pixel 330 to convert the displayed normal image unit into a black image unit or convert the displayed black image unit to a normal image unit.

Figure 5:
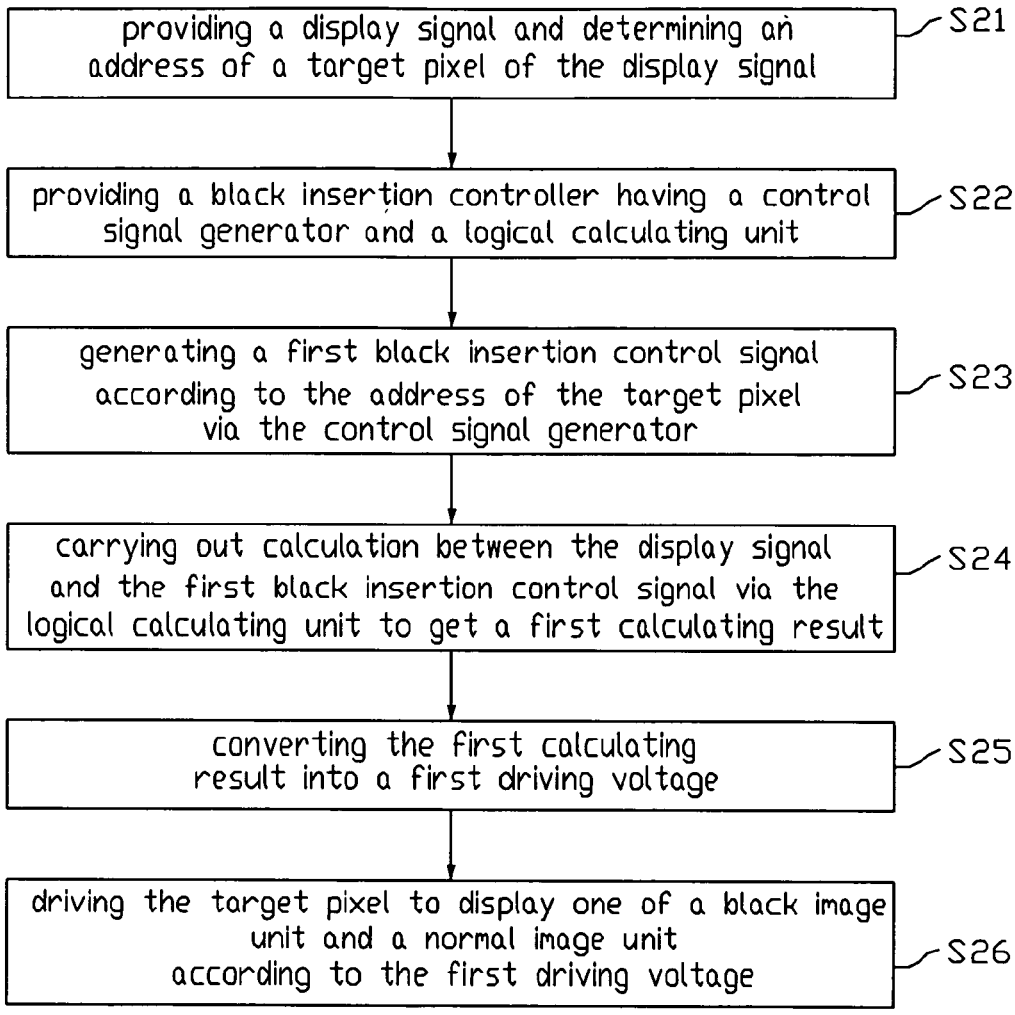
FIG. 5 is a flow chart of detailed processes of step S2 of the exemplary driving method of the LCD.

In detail, referring to FIG. 5, the step S1 of the driving method including the following sub-steps: sub-step S21, providing a display signal and determining an address of a target pixel 330 of the display signal; sub-step S22, providing a black insertion controller 305 having a control signal generator 410 and a logical calculating unit 420; sub-step S23, generating a first black insertion control signal according to the address of the target pixel 330 via the control signal generator 410; sub-step S24, carrying out calculation between the display signal and the first black insertion control signal via the logical calculating unit 420 to get a first calculating result; sub-step S25, converting the first calculating result into a first driving voltage; and sub-step S26, driving the target pixel 330 to display one of a black image unit and a normal image unit according to the first driving voltage.

Figure 6:
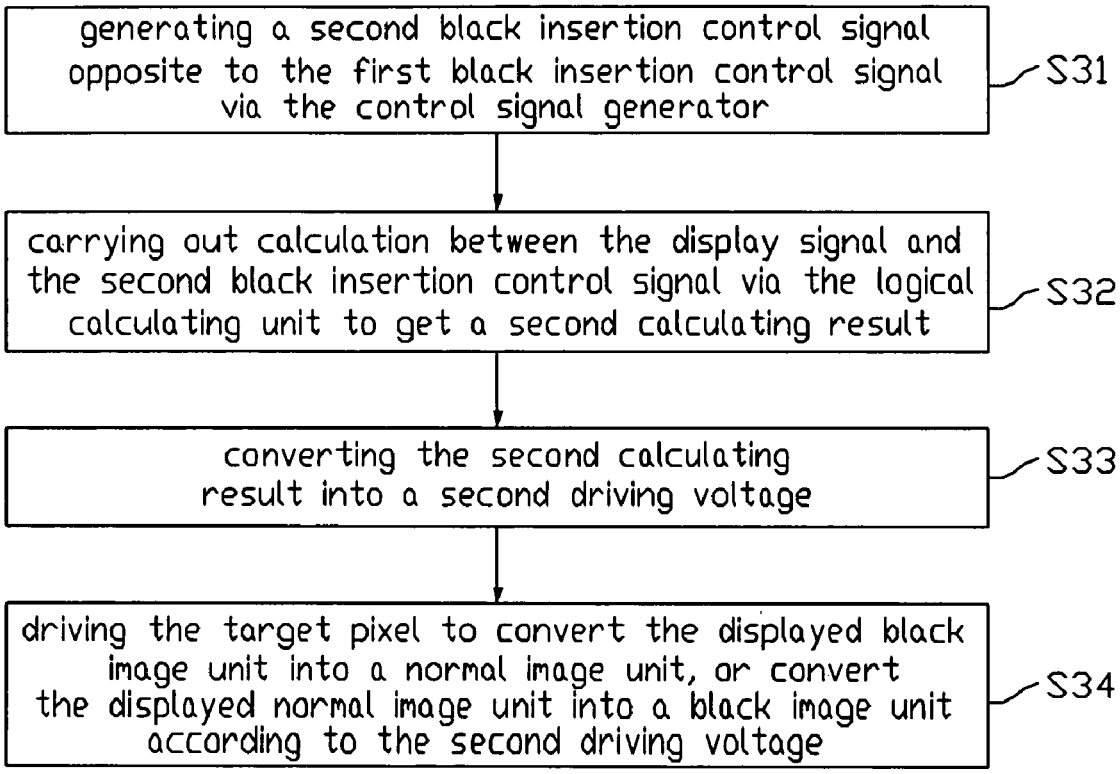
FIG. 6 is a flow chart of detailed processes of step S3 of the exemplary driving method of the LCD.
Figure 7:
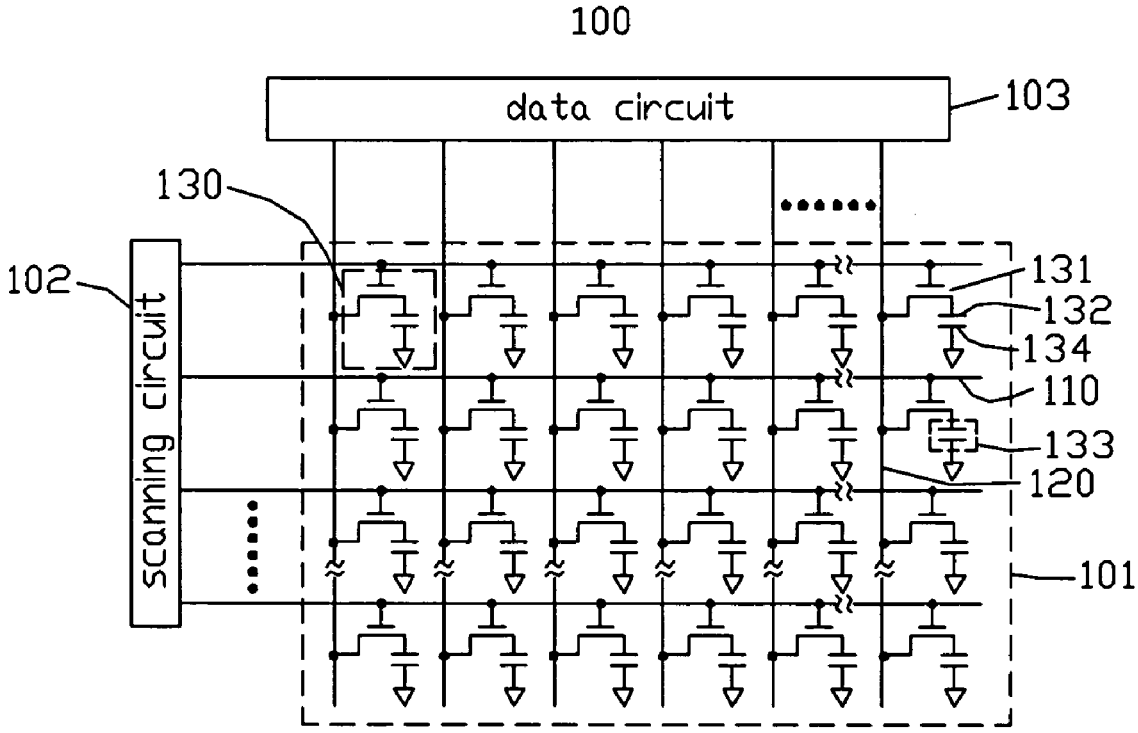
FIG. 7 (RELATED ART)
FIG. 7 is an abbreviated circuit diagram of an LCD, which is capable of utilizing a conventional black insertion driving method.

Moreover, referring to FIG. 6, the step S3 of the driving method including the following sub-steps: sub-step S31, generating a second black insertion control signal opposite to the first black insertion control signal via the control signal generator 410; sub-step S32, carrying out calculation between the display signal and the second black insertion control signal via the logical calculating unit 420 to get a second calculating result; sub-step S33, converting the second calculating result into a second driving voltage; and sub-step S34, driving the target pixel 330 to convert the displayed black image unit into a normal image unit, or convert the displayed normal image unit into a black image according to the second driving voltage.

In the LCD 300, the black insertion control units of the black insertion controller 305 to generate the black insertion control signals according to the addresses of the pixels 330, and the black insertion control signals control the pixels 330 to display corresponding normal image units or black image units. The black insertion control signals of the pixels 330 in the first sub-frame period T1 are opposite to that of the pixels 330 in the second sub-frame period T2. Thereby, in a complete frame period T0, each pixel 330 displays a corresponding normal image unit in one of the sub-frames T1, T2, and displays a black image unit in the other one of the sub-frames T1, T2. That is, normal image units and black image units are displayed by the LCD 300 alternately, such that an afterimage of the image unit displayed in a previous sub-frame period T1, T2 is removed from the perception of a viewer during a current sub-frame period T2, T1. Therefore, the problem of the residual image phenomenon can be solved.

Moreover, because the black insertion control signals of two directly adjacent pixels 330 in each of the sub-frame period T1, T2 are opposite to each other. Thereby, in each of the sub-frame periods T1, T2, the normal image units and the black image units are alternately arrayed in each row and column of the active matrix. In particular, the pixels 330 in odd rows and odd columns and the pixels 330 in even rows and even columns display black image units in the first sub-frame period T1, and display normal image units in the second sub-frame period T2. The pixels 330 in odd rows and even columns and the pixels 330 in even rows and odd columns display normal image units in the first sub-frame period T1, and display black image units in the second sub-frame period T2. Therefore, when the LCD 300 displays a still image in a plurality of sequential frames periods, a flicker phenomenon that may otherwise be manifested is averaged, and the skipping or jumping of the image that may otherwise be manifested can be diminished or even completely eliminated. As a result, the display quality of the LCD 300 is improved.

In a first alternative embodiments, the first four bits data stored in the first memory 415 can be changed to 1001, and the second four bits data stored in the second memory 416 can be changed to 0110. Thereby, the pixels 330 in odd rows and odd columns and the pixels 330 in even rows and even columns display normal image units in the first sub-frame period T1, and display black image units in the second sub-frame period T2. The pixels 330 in odd rows and even columns and the pixels 330 in even rows and odd columns display black image units in the first sub-frame period T1, and display normal image units in the second sub-frame period T2.

In a second alternative embodiments, the first four bits data stored in the first memory 415 can be changed to 1010, and the second four bits data stored in the second memory 416 can be changed to 0101. Thereby, the pixels 330 in odd columns display black image units in the first sub-frame period T1, and display normal image units in the second sub-frame period T2. The pixels 330 in even columns display normal image units in the first sub-frame period T1, and display black image units in the second sub-frame period T2.

In a third alternative embodiments, the first four bits data stored in the first memory 415 can be changed to 0011, and the second four bits data stored in the second memory 416 can be changed to 1100. Thereby, the pixels 330 in odd rows display black image units in the first sub-frame period T1, and display normal image units in the second sub-frame period T2. The pixels 330 in even rows display normal image units in the first sub-frame period T1, and display black image units in the second sub-frame period T2.

It is to be further understood that even though numerous characteristics and advantages of preferred and exemplary embodiments have been set out in the foregoing description, together with details of the structures and functions of the embodiments, the disclosure is illustrative only; and that changes may be made in detail within the principles of the present invention to the full extent indicated by the broad general meaning of the terms in which the appended claims are expressed.

What is claimed is:

1. A liquid crystal display, comprising:

a liquid crystal panel comprising a plurality of pixels;

a data circuit configured for driving the pixels; and a black insertion controller configured for controlling the data circuit to provide corresponding driving voltages for the pixels, the black insertion controller comprising a plurality of black insertion control units each having a control signal generator, the control signal generator being configured to generate a black insertion control signal and comprising a memory member, a selector member, and a multiplexer, the selector member reading data stored in the memory member according to an address of the pixel, and the multiplexer generating the black insertion control signal according to the data read by the selector member;

wherein the black insertion controller receives a display signal of the pixel, and generates the black insertion control signal according to the address of the pixel, the data circuit drives the pixel to display one of a black image unit and a normal image unit according to the first black insertion control signal in a first sub-frame period of a frame period, and the displayed black image unit of the pixel or the displayed normal image unit is converted into a normal image unit or a black image unit in a second sub-frame period of the frame period.

2. The liquid crystal display as claimed in claim 1, wherein the black insertion controller generates the black insertion control signal according to a least significant bit of horizontal address and a least significant bit of vertical address of the pixel.

3. The liquid crystal display as claimed in claim 1, wherein the black insertion control unit further comprises a logical calculating unit, and the logical calculating unit is configured for carrying out calculation between the display signal and the black insertion control signal.

4. The liquid crystal display as claimed in claim 3, wherein the logical calculating unit comprises an AND gate.

5. The liquid crystal display as claimed in claim 1, wherein the memory member includes a first memory and a second memory, each of which stores four bits data.

6. The liquid crystal display as claimed in claim 5, wherein the four bits data stored in the first and second memories are a selected pair of 0110 and 1001, 0011 and 1100, 0101 and 1010.

7. The liquid crystal display as claimed in claim 5, wherein the selector member comprises a first selector and a second selector, and the first and second selectors respectively read data from the first and second memories according to the address of the pixel.

8. A method for driving a liquid crystal display, the liquid crystal display comprising a liquid crystal panel having a plurality of pixels, the method comprising:

(a) dividing a frame period into a first sub-frame period and a second sub-frame period;

(b) providing a display signal and determining an address of a pixel corresponding to the display signal;

(c) providing a black insertion controller to generate a first black insertion control signal according to the address of the pixel, comprising providing first four bits data and second four bit data, reading a first datum from the first four bits data and a second datum from the second four bit data according to the address of the pixel, and selecting the first datum as a first black insertion control signal according to a first timing signal, wherein the black insertion controller comprises a plurality of black insertion control units each having a control signal generator, the control signal generator comprises a first memory and a second memory configured for providing the first and second four bits data respectively, a first selector and a second selector configured for reading the first memory and the second memory respectively, and a multiplexer configured for selecting a corresponding datum;

(d) providing a data circuit to drive the pixel to display one of a black image unit and a normal image unit according to the black insertion control signal;

(e) converting the displayed black image unit into a normal image unit, or converting the displayed normal image unit into a black image;

wherein steps (b), (c), and (d) are operated in the first sub-frame period, and step (e) is operated in the second sub-frame period.

9. The method for driving a liquid crystal display as claimed in claim 8, wherein the first four bits data and the second four bits data are a selected pair of 0110 and 1001, 0011 and 1100, 0101 and 1010.

10. The method for driving a liquid crystal display as claimed in claim 8, wherein each of the first and second selectors reads the corresponding one of the first and second memories according to one of a least significant bit of horizontal address and a least significant bit of vertical address of the pixel.

11. The method for driving a liquid crystal display as claimed in claim 8, wherein step (c) further comprises: carrying out calculation between the display signal and the first black insertion control signal to get a first calculating result.

12. The method for driving a liquid crystal display as claimed in claim 11, wherein the calculation comprises Boolean AND calculation.

13. The method for driving a liquid crystal display as claimed in claim 11, wherein step (d) comprises: providing a data circuit; converting the first calculating result to a first driving voltage via the data circuit; and driving the pixel to display one of the black image unit and the normal image unit via the first driving voltage.

14. The method for driving a liquid crystal display as claimed in claim 13, wherein step (e) comprises: selecting the second datum as a second black insertion control signal according to a second timing signal; carrying out calculation between the display signal and the second black insertion control signal to get a second calculating result; and converting the second calculating result into a second driving voltage.

15. The method for driving a liquid crystal display as claimed in claim 14, wherein the second black insertion control signal is opposite to the first black insertion control signal.

16. A method for driving a liquid crystal display, the liquid crystal display comprising a liquid crystal panel having a plurality of pixels, the method comprising:

(a) dividing a frame period into a first sub-frame period and a second sub-frame period;

(b) providing a display signal and determining an address of a pixel corresponding to the display signal;

(c) providing a black insertion controller to generate a black insertion control signal according to the address of the pixel, wherein the black insertion controller comprises a plurality of black insertion control units each having a control signal generator, the control signal generator comprises a memory member, a selector member, and a multiplexer, the selector member reads data stored in the memory member according to the address of the pixel, and the multiplexer generates the black insertion control signal according to the data read by the selector member;

(d) providing a data circuit to drive the pixel to display one of a black image unit and a normal image unit according to the black insertion control signal;

(e) converting the displayed black image unit into a normal image unit, or converting the displayed normal image unit into a black image;

wherein steps (b), (c), and (d) are operated in the first sub-frame period, and step (e) is operated in the second sub-frame period.

17. The method for driving a liquid crystal display as claimed in claim 16, wherein the memory member comprises a first memory and a second memory configured for providing a first and a second four bits data respectively, and the selector member comprises a first selector and a second selector configured for reading a first and a second datum from the first memory and the second memory respectively.

18. The method for driving a liquid crystal display as claimed in claim 17, wherein the multiplexer selects the first datum as a first black insertion control signal according to a first timing signal in step (c), and selects the second datum as a second black insertion control signal according to a second timing signal in step (e).

19. The method for driving a liquid crystal display as claimed in claim 18, wherein the second black insertion control signal is opposite to the first black insertion control signal.

* * * * *